US010625402B2

(12) United States Patent
Jensen

(10) Patent No.: US 10,625,402 B2
(45) Date of Patent: Apr. 21, 2020

(54) RATCHETING SPANNER

(71) Applicant: Michael Thomas Jensen, Richmond, TX (US)

(72) Inventor: Michael Thomas Jensen, Richmond, TX (US)

( * ) Notice: Subject to any disclaimer, the term of this patent is extended or adjusted under 35 U.S.C. 154(b) by 190 days.

(21) Appl. No.: 15/657,944

(22) Filed: Jul. 24, 2017

(65) Prior Publication Data

US 2019/0022832 A1 Jan. 24, 2019

(51) Int. Cl.
*B25B 13/46* (2006.01)
*B25B 13/08* (2006.01)

(52) U.S. Cl.
CPC ..... *B25B 13/463* (2013.01); *B25B 13/08* (2013.01)

(58) Field of Classification Search
CPC ..... B25B 13/463; B25B 13/08; B25B 13/46
See application file for complete search history.

(56) References Cited

U.S. PATENT DOCUMENTS 1,060,185 A 4/1913 Hitt
1,384,684 A 7/1921 Watkins
1,422,121 A 7/1922 Millen
2,574,424 A * 11/1951 Szetela ..... B25B 13/46 81/176.15
2,578,686 A 12/1951 Fish
2,810,313 A 10/1957 Hermanson
2,851,914 A 9/1958 Zeckzer
3,077,801 A * 2/1963 Rostad ..... B25B 13/08 81/61
4,554,847 A * 11/1985 DeSantis ..... B25B 13/46 81/111
4,718,315 A * 1/1988 Nitschmann ..... B25B 13/46 81/117
5,282,830 A * 2/1994 Reynolds ..... B25B 23/0071 81/58.2
2004/0211298 A1 10/2004 Williams, Sr.
2006/0137492 A1* 6/2006 Melos ..... B25B 13/463 81/58.2
2010/0122608 A1* 5/2010 Chen ..... B25B 13/04 81/60
2010/0229692 A1* 9/2010 Cubillas ..... B25B 13/08 81/58.2

(Continued)

FOREIGN PATENT DOCUMENTS

WO WO-2010124216 A2 * 10/2010 ..... B25B 13/463
WO WO-2013163731 A1 * 11/2013 ..... B25B 13/08

*Primary Examiner* — Christopher R Harmon

(57) ABSTRACT

A ratcheting spanner which can be installed on a rotatable body along a vector substantially perpendicular to an axis of rotation. The ratcheting spanner comprising a spanner body, a ratchet ring, and a plurality of pawls. The pawls can rotationally couple the spanner body to the ratchet ring in one or both directions relative to the axis of rotation. The ratcheting spanner can have a home key to facilitate the alignment of the openings in the spanner body and the ratchet ring. The direction of rotational coupling of the pawls and the action of the home key can be controlled by one or more selector controls. A driven ratcheting spanner can be constructed to further allow transmission of torque to the ratchet ring without movement of the spanner body. A method of using a ratcheting spanner to rotate a rotatable body.

9 Claims, 7 Drawing Sheets

(56) References Cited

U.S. PATENT DOCUMENTS

| | | | | |
|---|---|---|---|---|
| 2012/0060652 | A1* | 3/2012 | Gapp | B25B 13/08 81/58.2 |
| 2014/0041487 | A1* | 2/2014 | Chien | B25B 13/04 81/58.2 |
| 2016/0221163 | A1* | 8/2016 | Trucchio | B25B 17/00 |
| 2016/0235200 | A1* | 8/2016 | De Bruin | F16M 11/24 |

* cited by examiner

RATCHETING SPANNER

CROSS-REFERENCE TO RELATED APPLICATIONS

None

FIELD OF THE DISCLOSURE

The disclosure generally relates to a spanner type tool with ratcheting behavior and methods of rotating a rotatable body using such a tool.

BACKGROUND

Spanner type wrenches, sometimes referred to as c-spanners, pin spanners, or hook spanners, generally consist of a handle section coupled to a curved arm, which can be fixed or pivotally articulated, and have an engagement feature on the end. These tools are commonly used to turn threaded features or other rotatable bodies which are of large diameter, require substantial torque, require many engagement positions, or are part of assemblies which extend for a significant length along the axis of rotation. This is especially true where the rotatable body is the same diameter or smaller than the diameter of the rotatable body assembly. In these cases, the ability to install the spanner along a vector, or series of vectors, substantially perpendicular to the axis of rotation is often required.

The use of spanner engagement features, such as radial holes or slots, is also beneficial in the design of rotatable bodies with space or strength constraints. These features often require less radial thickness and cross-sectional area than other common rotational engagement features, such as convex-polygonal sections, and offer superior torque transmission. It is also possible to increase the number of spanner engagement features with generally minimal impact on the torque capacity of the rotatable body. In contrast, typical convex-polygon sections generally decrease in torque capacity as the face count increases.

A traditional disadvantage of a spanner type wrench is the need to either rotate the tool completely around the rotational axis to provide continuing rotation of the rotatable body, or frequently reposition the engagement between the tool and the rotatable body. This repositioning is also more difficult than that of a tool, such as a box wrench, since the spanner must be properly positioned both rotationally and axially, relative to the axis of rotation, instead of only rotationally aligned. This often requires visual rather than tactile placement of the tool into the engagement features of the rotatable body. The alternative of rotating the tool completely around the axis of rotation is often not possible due to limited access to the rotatable body, or limited ability to rotate the tool, such as when the spanner must be positively retained with a safety cable. These limitations lead to substantial time being consumed repositioning the spanner, especially when a rotatable body requires many rotations or conditions hinder the repositioning process.

A spanner as suggested by U.S. Pat. No. 2,810,313 (1957) to Hermanson attempts to address some of these disadvantages by allowing the dogs that interact with the engagement features on the rotatable body to pivot. Despite this modification substantial functional limitations remain. This design still requires repositioning of the dogs on the tool into the next engagement feature on the rotational body in essentially the same fashion as a conventional spanner. The pivoting of the dogs also generally weakens their load carrying capability and requires a plurality of engagement features at specific positions on the rotatable body to function effectively. This design also requires either axial installation, or the placement of one dog followed by the rotation of the tool into engagement which utilizes a significant amount of the available rotational arc.

A need therefore exists for a tool providing the functional benefits of a spanner wrench which retains the ability to be installed along a vector substantially perpendicular to the rotational axis and which also allows continuous rotation of a rotatable body without continuous rotation of the tool or repositioning of the tool on the engagement features of the rotatable body.

SUMMARY

An embodiment of a ratcheting spanner can have a spanner body with an opening which allows it to be installed on a rotatable body along a vector substantially perpendicular to the axis of rotation. In this and other embodiments, references to a vector substantially perpendicular to the axis of rotation can be a literal single vector, a series of vectors, or a curve in a plane substantially perpendicular to the axis of rotation. A ratchet ring can be disposed within the spanner body. The ratchet ring can have an opening such that it can be installed on a rotatable body along a vector substantially perpendicular to the axis of rotation. The ratchet ring can have an engagement boss for interacting with the spanner engagement feature or features of the rotatable body. The ratchet ring can have ratchet ring teeth disposed along its perimeter. The ratchet ring can be rotationally coupled to the spanner body through a plurality of pawls. These pawls can produce ratcheting behavior such that rotation of the spanner body in one direction is coupled with the ratchet ring, but the rotation is not coupled when rotated the opposite direction. This behavior can be controllable to produce coupled movement in either direction. Additionally, embodiments can be constructed where the behavior can be controlled to be coupled in both directions or fully decoupled.

The ratcheting spanner can have a home key disposed between the ratchet ring and spanner body. The home key can provide a detent or locking behavior between the spanner body and the ratchet ring. The ratchet ring can have ratchet ring home geometry to work cooperatively with the home key to produce this behavior. The action of the home key can facilitate the positioning of the spanner into the home position, where the openings in the spanner body and the ratchet ring are aligned, allowing for installation onto or removal from the rotatable body. The home key can be designed such that the behavior of the home key, and the tactile detent feedback provided to the user, is substantially different in the home position compared to other positions, such as when contacting the ends of the ratchet ring.

The behavior of the home key can be made controllable by a selector control, which can enable, disable, or modify the action of the home key. This selector control can be the same selector control which determines the ratcheting direction, allowing simultaneous control and simple programming of combined control states.

A driven ratcheting spanner can comprise a spanner body, a ratchet ring, and a plurality of drive engagement bodies. The drive engagement bodies allow rotational coupling of the spanner body to the ratchet ring and, additionally, provide a means to transmit torque to the ratchet ring without requiring rotation of the spanner body relative to the ratchet ring.

An embodiment of a method for rotating a rotatable body can include providing a ratcheting spanner and a rotatable body with spanner engagement features. The ratcheting spanner can be installed on the rotatable body along a vector substantially perpendicular to the axis of rotation. The ratcheting spanner can be rotated bidirectionally to produce monodirectional rotation of the rotatable body. The ratcheting spanner can be returned to the home position where the openings in the spanner body and ratchet ring are aligned. The ratcheting spanner can be removed from the rotatable body along a vector substantially perpendicular to the axis of rotation.

DETAILED DESCRIPTION OF THE INVENTION

Embodiments of a ratcheting spanner are described. One or more of these embodiments provide a tool which maintains the strength and access benefits of a conventional spanner while providing continuous rotation of the rotatable body without continuous rotation of the ratcheting spanner or repositioning of the engagement boss relative to the engagement features on the rotatable body. These benefits are also achieved without requiring multiple, or a specific pattern of, spanner engagement features on the rotatable body. One or more of these embodiments also provides a tool which is faster and easier to return to the home position than conventional open-ended ratcheting tools. These and other benefits of one or more aspects will become apparent from the following description and accompanying drawings.

Figure 1:
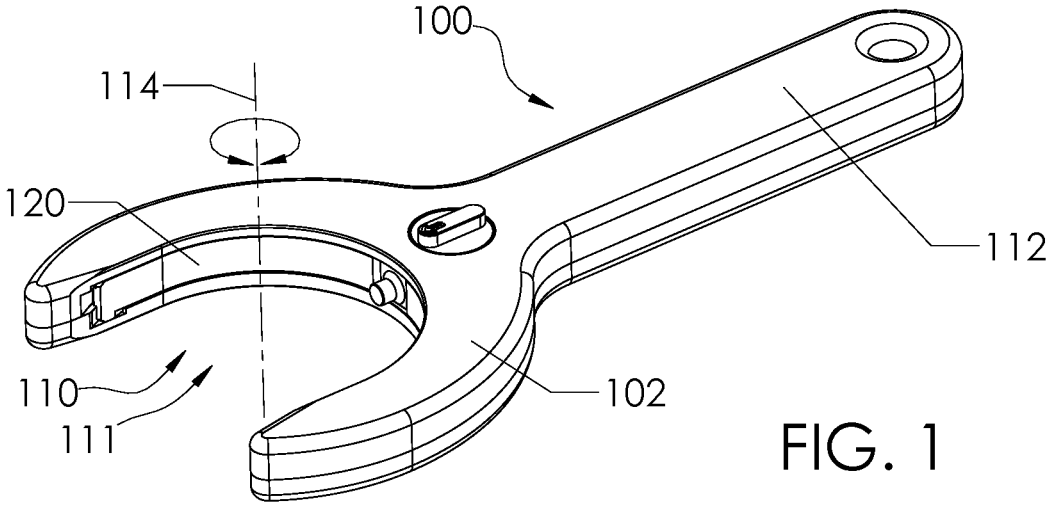
FIG. 1 shows a view of an embodiment of a ratcheting spanner in a home position.
Figure 2:
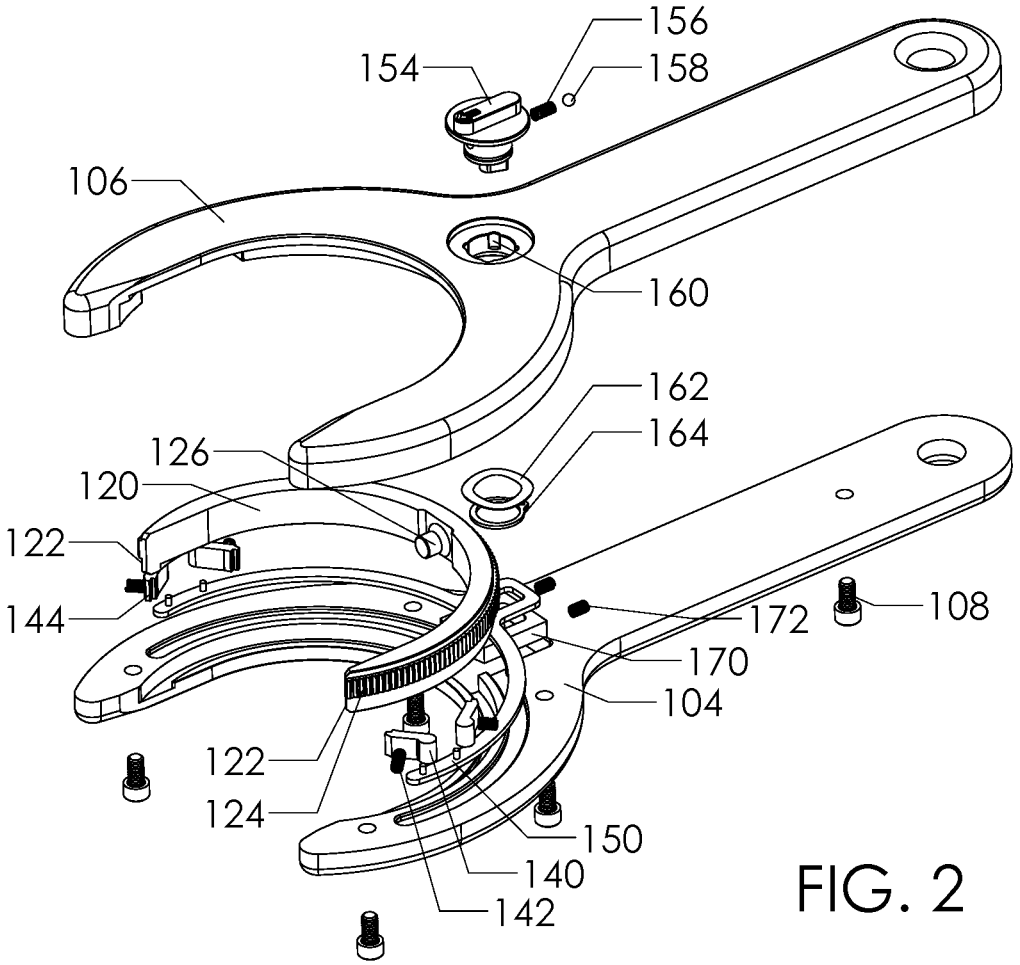
FIG. 2 shows an exploded view of the ratcheting spanner of FIG. 1.
Figure 3:
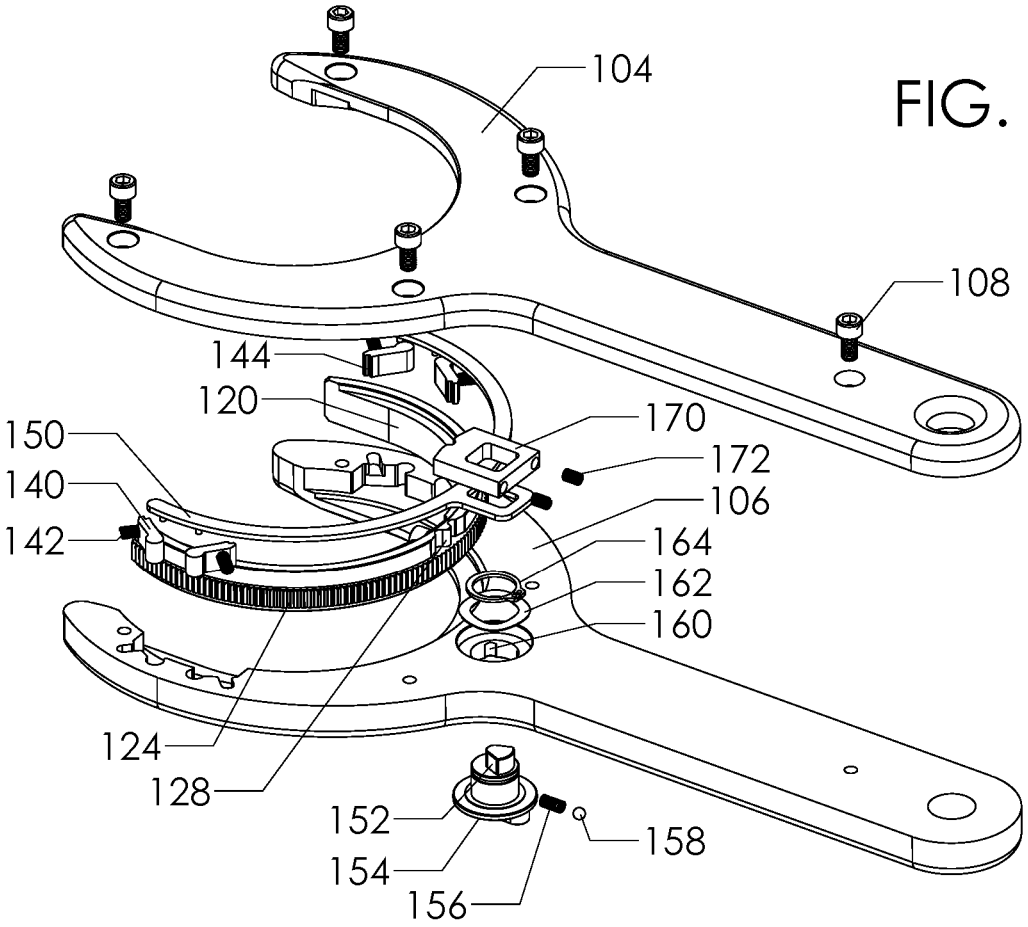
FIG. 3 shows an alternate exploded view of the ratcheting spanner of FIG. 1.

Referring to FIG. 1-FIG. 3, an embodiment of a ratcheting spanner comprises a ratcheting spanner assembly 100 which can include a spanner body 102 which, in this embodiment, is comprised of a lower body 104 and an upper body 106 which are constrained together with bolts 108. One end of the spanner body has an opening 110 to allow installation onto a rotatable body and the other end can have an extended handle section 112. Alternate embodiments of the spanner body could consist of a single component, further separate the extended handle section into one or more additional components, or remove the extended handle section completely.

The spanner body 102 encloses a ratchet ring 120 which contains an opening 111 to allow installation onto the rotatable body. The ratchet ring 120 and spanner body 102 can rotate relative to each other about an axis of rotation 114. The ratchet ring 120 can have ratchet ring teeth 124 disposed along the perimeter, and an engagement boss 126 extending towards the axis of rotation 114 for engaging with the rotatable body. In this embodiment, the ratchet ring teeth 124 extend radially from the ratchet ring 120 with respect to the axis of rotation 114; however, in an alternate embodiment they could extend axially. Additionally, the engagement boss 126 in this embodiment is shown as being an integral feature of the ratchet ring 120; however, in other embodiments it could be a pressed pin, or otherwise attached component. In alternate embodiments, the engagement boss can also be a non-cylindrical feature such as the prismatic projection of a hook spanner, or other specialized geometry that maintains the ability of the ratchet ring 120 to be installed along a vector substantially perpendicular to the axis of rotation 114.

The ratchet ring 120 can be rotationally coupled to the spanner body 102 through a plurality of pawls 140 which can be biased into contact with the ratchet ring by pawl springs 142. In this embodiment, the pawls are each shown with a single set of pawl teeth 144 which can engage with the ratchet ring teeth 124; however, alternate embodiments can be constructed using pawls with multiple sets of teeth which could be oriented in opposing directions. In this embodiment, the pawls 140 are pivotally connected to the spanner body 102, but in alternate embodiments the pawls could be slidably connected. The pawl teeth 144 and ratchet ring teeth 124 can have a plurality of engagement positions where the rotational position of the ratchet ring 120 relative to the spanner body 102 about the axis of rotation 114 allows the teeth to mesh and rotationally couple the spanner body and ratchet ring. The pawls 140 can be positioned such that despite the opening 111 in the ratchet ring 120 an engagement position for at least one pawl is available with minimal rotation from any orientation of the ratchet ring relative to the spanner body 102.

The engagement of the pawls 140 with the ratchet ring 120 can be controlled by a selector 150 which can work against the pawl springs 142 to position the pawls. The position of the selector 150 can be controlled by interaction with a selector profile geometry 152 on a selector control 154. In this embodiment, the selector 150 is shown as a sheet-metal-type structure with bosses, but in alternate embodiments the selector could be a formed wire, a flexible control line, or other structure which allows physical coupling between the selector control 154 and the pawls 140. The position of the selector control 154 can be biased into specified locations by the action of a selector detent spring 156 on a bearing ball 158 which engages with detent features 160 in the spanner body 102. In this embodiment, the selector control 154 is axially constrained by a spring 162 and a snap ring 164 and is also shown operating based on rotation; however, alternate embodiments can be created using a sliding motion for control. The illustrated embodiment provides for bidirectional ratcheting without repositioning of the ratcheting spanner assembly 100; however, a simpler embodiment with a single direction ratcheting behavior could be constructed which could eliminate the selector 150 and some of the pawls 140.

The position of the ratchet ring 120 can also be biased into a home position where the openings 110 and 111 in the spanner body 102 and ratchet ring, respectively, are aligned by the action of a home key 170. The home key 170 can be biased into contact with the ratchet ring 120 by one or more home key springs 172. The interaction of the home key 170 on the ratchet ring 120 or a ratchet ring home geometry 128 can be used to generate a detent or locking behavior in a home position. This behavior can greatly simplify and accelerate the process of returning the ratcheting spanner assembly 100 to a home position. The disposition of the spanner body 102, the ratchet ring 120, and the pawls 140, as well as the design of the pawl teeth 144 and ratchet ring teeth 124 can be controlled so that an engagement position, where the teeth mesh, aligns with a home position. Aligning an engagement position with a home position facilitates finding the home position since it is a natural resting position for the ratchet mechanism and not an unstable position between engagements.

The engagement of the home key 170 with the ratchet ring 120 can also be controlled or modified by a selector profile geometry 152 on a sector control 154 which can act against the home key springs 172 to prevent engagement of the home key 170 with the ratchet ring 120 and the ratchet ring home geometry 128. This selector profile geometry 152 and selector control 154 can be the same as the one which interacts with the selector 150 for control of the pawls 140 or a separate implementation. In the illustrated embodiment, the selector profile geometry 152 for interaction with the selector 150 and the home key 170 is the same; however, these geometries can be different for alternate embodiments depending on the desired behavior of each element and the desired combined states. One skilled in the art, with the aid of this disclosure, could create a wide variety of these behaviors without undue experimentation.

Figure 4:
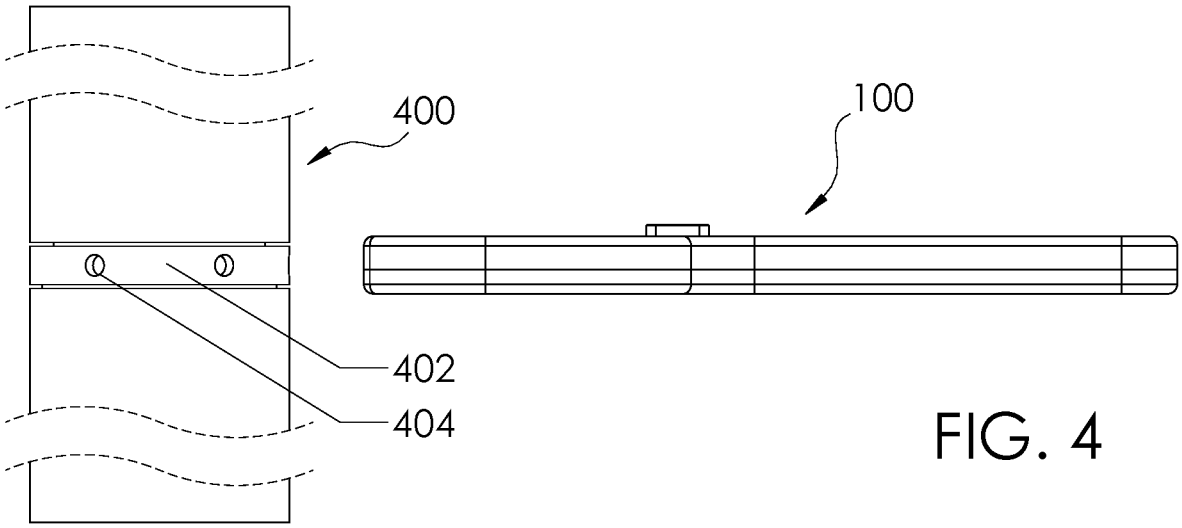
FIG. 4 shows a ratcheting spanner prior to engagement to a rotatable body.

Referring to FIG. 4, a ratcheting spanner assembly 100 is shown prior to engagement with a rotatable body assembly 400. The rotatable body assembly 400 comprises a rotatable body 402 which has spanner engagement features 404. These features can be radially drilled holes, slots, or other application specific geometry that allows for installation of the engagement boss 126 into the spanner engagement features 404.

Figure 5:
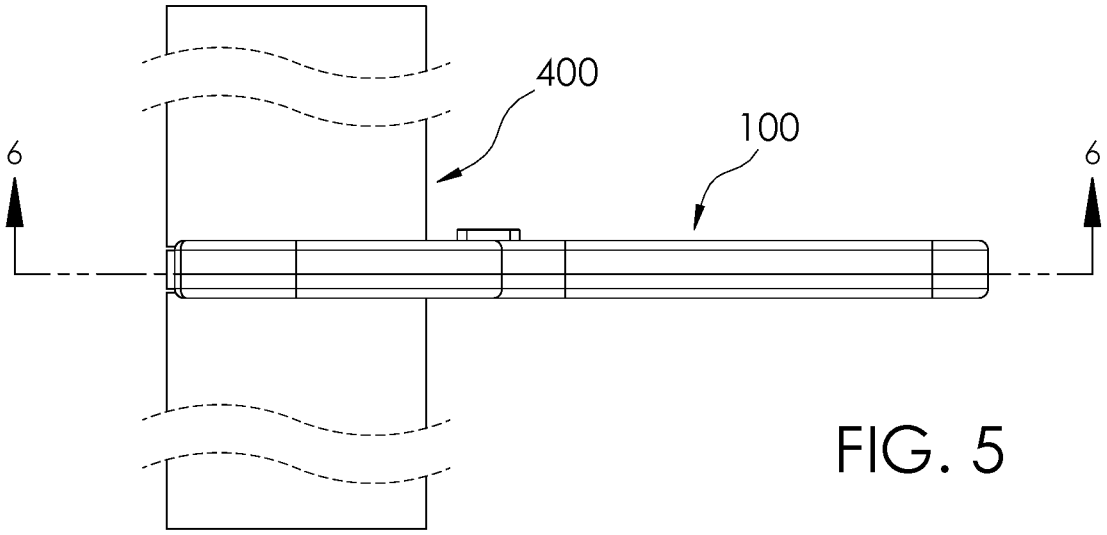
FIG. 5 shows the ratcheting spanner of FIG. 4 engaged with the rotatable body of FIG. 4.

Referring to FIG. 5, the ratcheting spanner assembly 100 is shown engaged with the rotatable body assembly 400. The installation of the ratcheting spanner assembly 100 onto the rotatable body assembly 400 can occur along a vector which is substantially perpendicular to the axis of rotation 114.

Figure 6:
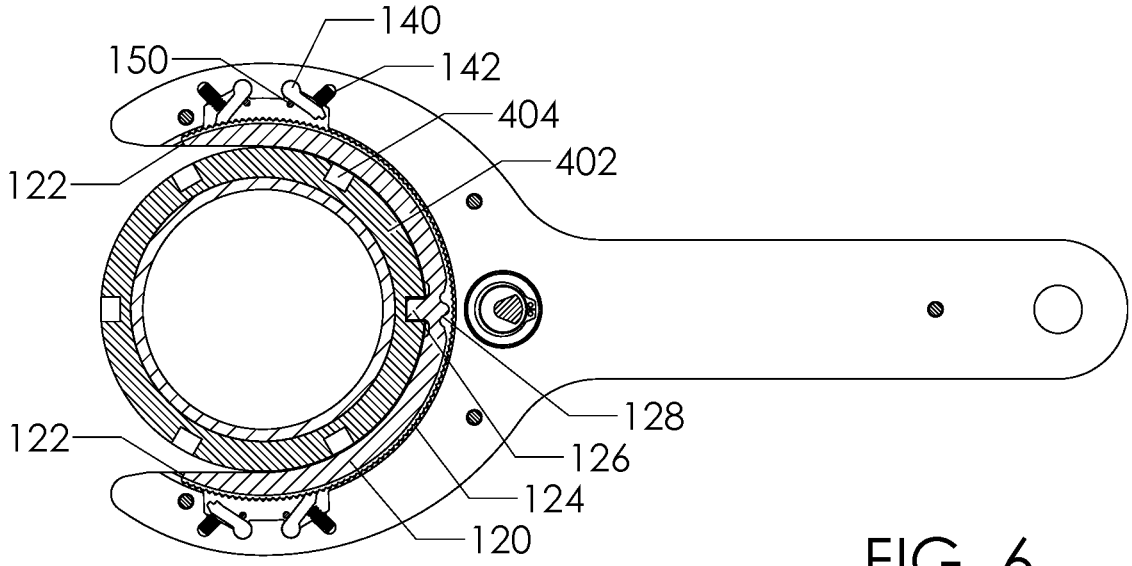
FIG. 6 shows a cross section of the ratcheting spanner of FIG. 5 engaged on the rotatable body of FIG. 5.

Referring to FIG. 6, the ratcheting spanner assembly 100 is shown engaged with the rotatable body 402 through the interaction of the spanner engagement features 404 and the engagement boss 126. This figure also shows the selector 150 positioned to move the pawls 140 into a position where the movement of the spanner body 102 counter clockwise will translate into counter clockwise rotation of the ratchet ring 120 and the rotatable body 402. Clockwise rotation of the spanner body 102 will not engage the pawl teeth 144 with the ratchet ring teeth 124 allowing rotation of the spanner body 102 relative to the ratchet ring 120 and the rotatable body 402 without repositioning of the engagement boss 126 relative to the rotatable body.

Referring to FIG. 7-FIG. 11, detailed views of a home key 170 are shown with a ratchet ring 120 in various orientations to demonstrate the different behaviors of the home key as the ratchet ring is rotated relative to the spanner body 102 about the axis of rotation 114. In this embodiment, the home key 170 has been designed to provide minimal tactile feedback when contacting a ratchet ring end 122 and a substantial detent when in the home position.

Figure 7:
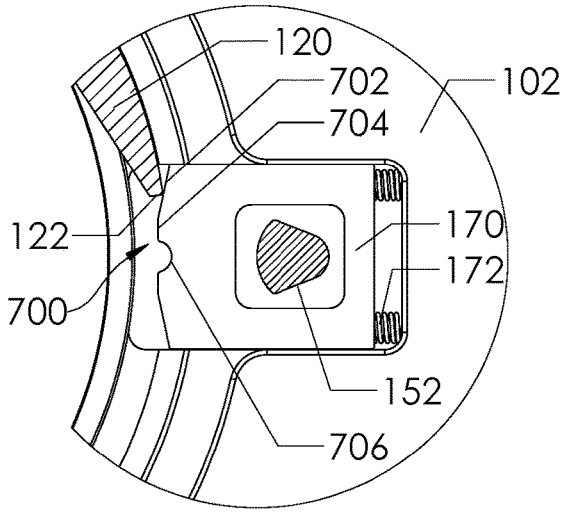
FIG. 7 shows a detailed view of an embodiment of a ratcheting spanner with a ratchet ring, a home key, and a selector profile geometry where a ratchet ring end of the ratchet ring is approaching contact with the home key.

In FIG. 7 a ratchet ring end 122 is approaching a home key engagement surface 700 on a home key 170 comprised of an outside contact surface 702, a front contact surface 704, and a home contact surface 706. In this embodiment, the outside contact surface 702 is designed to create a low-angle wedge with the approaching ratchet ring end 122 whereby the home key 170 is retracted with minimal additional rotational torque required on the spanner body 102. This minimal torque change prevents tactile feedback to the user and allows for clear differentiation from the feedback at the home position. In this embodiment, the home key engagement surface 700 is comprised of the previously mentioned three surfaces; however, in alternate embodiments surfaces could be added or removed based on the desired home key 170 behavior.

Figure 8:
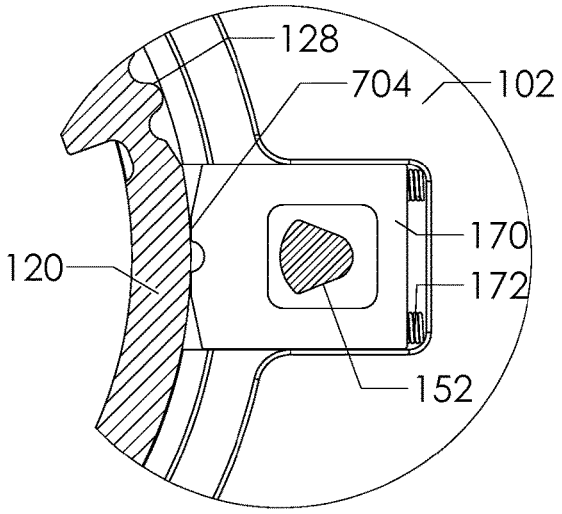
FIG. 8 shows a detailed view of the home key of FIG. 7 contacting the ratchet ring of FIG. 7 away from the home position.

In FIG. 8 the front contact surface 704 of the home key 170 is in contact with the outer diameter of the ratchet ring 120 and provides minimal resistance to the continued rotation of the spanner body 102 relative to the ratchet ring and thus no tactile feedback to the operator.

Figure 9:
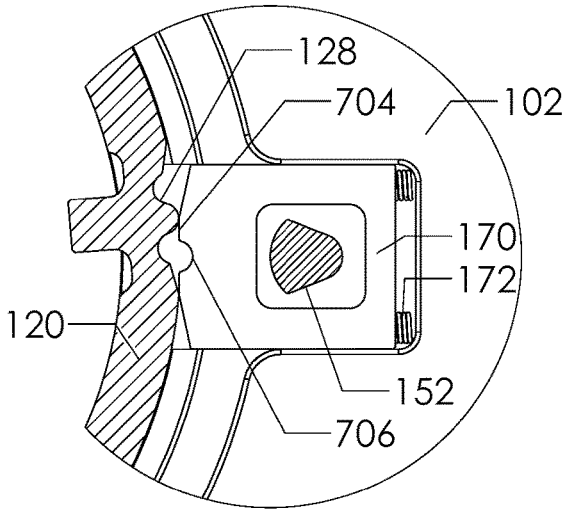
FIG. 9 shows a detailed view of the home key of FIG. 7 contacting the ratchet ring of FIG. 7 near the home position.

In FIG. 9 a ratchet ring home geometry 128 is approaching the home key 170. In this embodiment, the home key engagement surface 700 along with the ratchet ring home geometry 128 have been designed so that there is minimal movement of the home key 170 relative to the ratchet ring 120 as the ratchet ring approaches the home position. This results in minimal change to the torque required on the spanner body 102 to continue rotating relative to the ratchet ring 120. This prevents extra detent feedback to the user near the home position.

Figure 10:
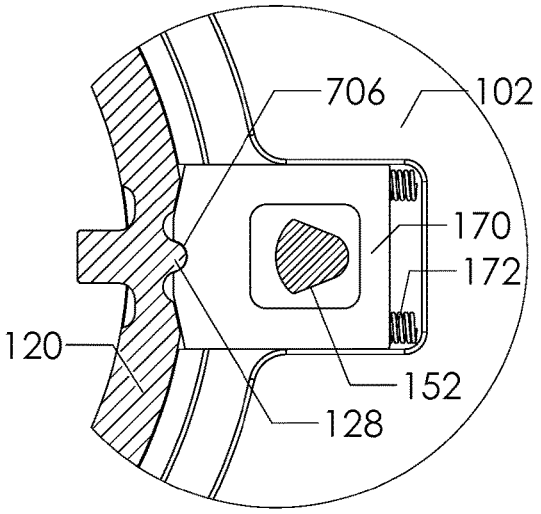
FIG. 10 shows a detailed view of the home key of FIG. 7 contacting the ratchet ring of FIG. 7 in the home position.

In FIG. 10 the ratcheting spanner assembly 100 is in the home position with the openings 110 and 111 in the spanner body 102 and the ratchet ring 120, respectively, aligned. In this position, the home contact surface 706 of the home key 170 is fully engaged with the ratchet ring home geometry 128. The design of these elements requires an additional input of torque on the spanner body 102 to continue rotation. This additional torque provides tactile detent feedback to the user indicating that the home position has been reached. One skilled in the art, with the aid of this disclosure, will recognize that the design of the home key engagement surface 700 and ratchet ring home geometry 128, along with the home key springs 172, can modified to create a wide range of detent and locking behaviors, which can be different at the ratchet ring ends, home position, and other rotational positions, without undue experimentation.

Figure 11:
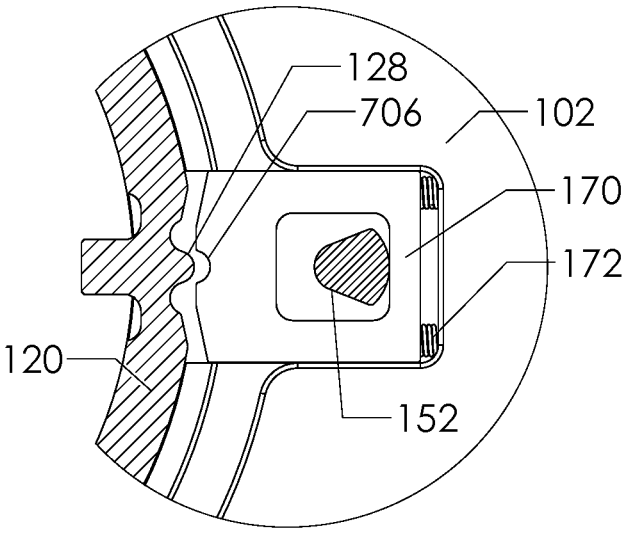
FIG. 11 shows a detailed view of the home key of FIG. 7 removed from contact with the ratchet ring of FIG. 7 by contact with the selector profile geometry of FIG. 7.

In FIG. 11 the ratcheting spanner assembly 100 is in a home position with the openings 110 and 111 in the spanner body 102 and the ratchet ring 120, respectively, aligned, but the home key 170 is prevented from engaging with the ratchet ring home geometry 128 by contact with the selector profile geometry 152. This contact allows the selector control 154 to disable the action of the home key 170 preventing detents on every rotation when the user is not trying to return the ratcheting spanner to the home position. This behavior can be combined with the selector control's 154 ability to move the selector 150 to allow simultaneous control of both ratcheting direction and home key 170 activation. This allows for programming combined control states by design of the selector profile geometry 152 and positioning of detent features 160 in the spanner body 102. One skilled in the art, with the aid of this disclosure, could produce a wide variety of state combinations without undue experimentation.

Figure 12:
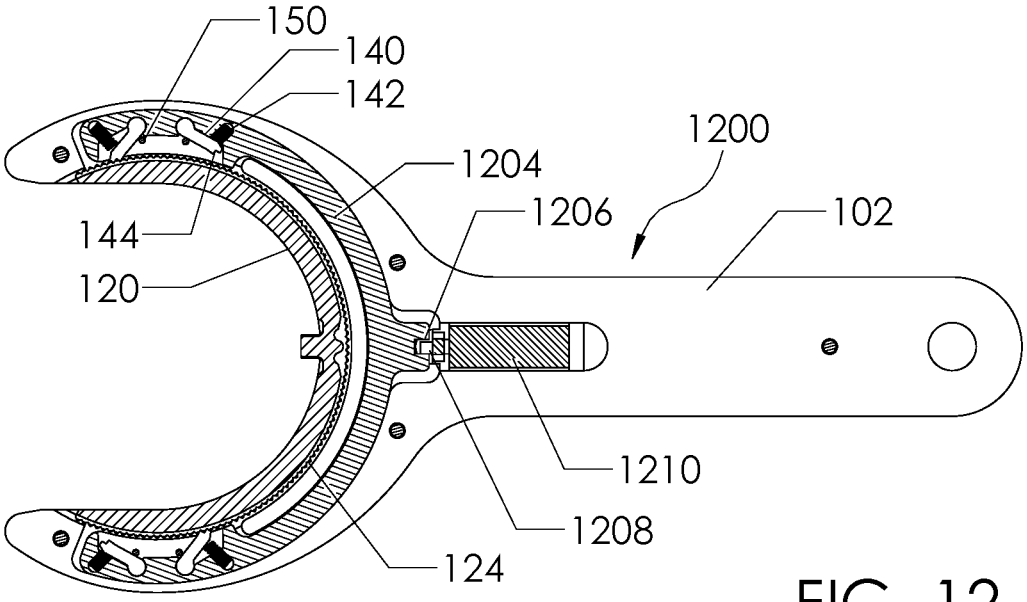
FIG. 12 shows an embodiment of a driven ratcheting spanner where the drive engagement bodies comprise a plurality of pawls disposed within a mobile carrier.

Referring to FIG. 12, a section view of a driven ratcheting spanner 1200 is shown. The driven ratcheting spanner 1200 comprises a spanner body 102, a ratchet ring 120, and drive engagement bodies which provide a means to generate rotation of the ratchet ring without requiring relative movement of the spanner body. In this embodiment, the drive engagement bodies comprise, a plurality of pawls 140 and pawl springs 142 which are disposed within a mobile carrier 1204. The mobile carrier 1204 can rotate within the spanner body 102 around the ratchet ring 120 by at least the rotational distance required to move the pawl teeth 144 to the next engagement position with the ratchet ring teeth 124.

In the illustrated embodiment, alternating rotational motion in the mobile carrier 1204 is generated by an eccentric pin 1208 driven by a rotational actuator 1210 within a slot 1206 in the mobile carrier. Since the rotational movement of the mobile carrier 1204 is sufficient to advance the pawls 140 at least one engagement position, the ratcheting behavior of the pawls converts the alternating rotation of the mobile carrier into continuous rotation of the ratchet ring 120 in the direction determined by the position of the sector 150. This motion can be generated without moving the spanner body 102, however, the ability to manually operate the driven ratcheting spanner by moving the spanner body 102 remains. One skilled in the art will recognize that many different means can be used to create the alternating rotation of the mobile carrier and could, with the aid of this disclosure, generate alternate embodiments based on these means without undue experimentation.

Figure 13:
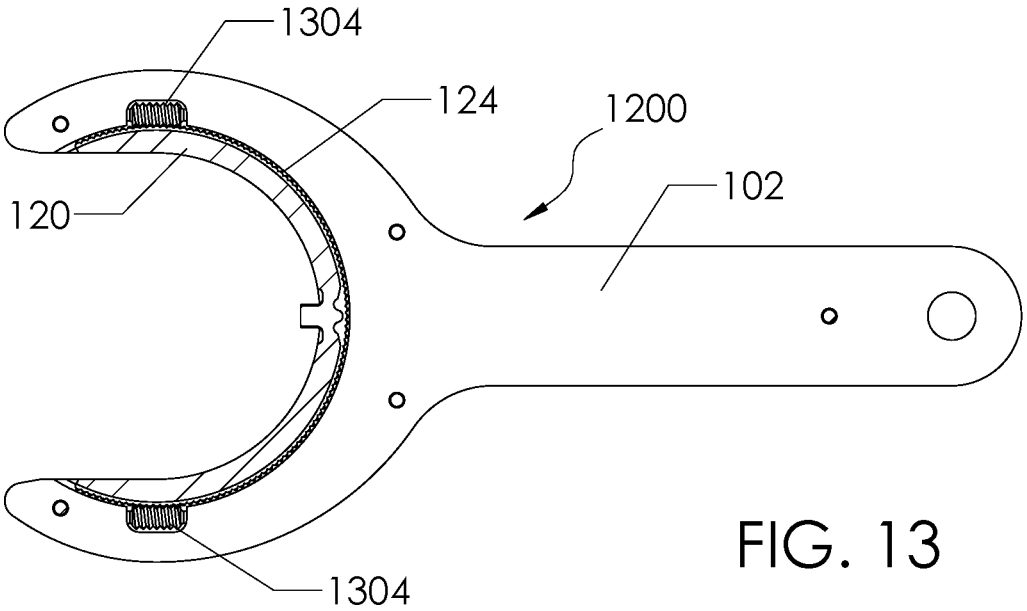
FIG. 13 shows an embodiment of a driven ratcheting spanner where the drive engagement bodies comprise worm gears.

In FIG. 13 a simplified section of a driven ratcheting spanner 1200 is shown wherein the drive engagement bodies comprise worm gears 1304 which can drive a ratchet ring 120 which has ratchet teeth 124 which are designed to mesh with the worm gears 1304. The coordinated rotation of the worm gears 1304 allows transmission of torque to the ratchet ring 120 without relative movement of the spanner body 102.

Figure 14:
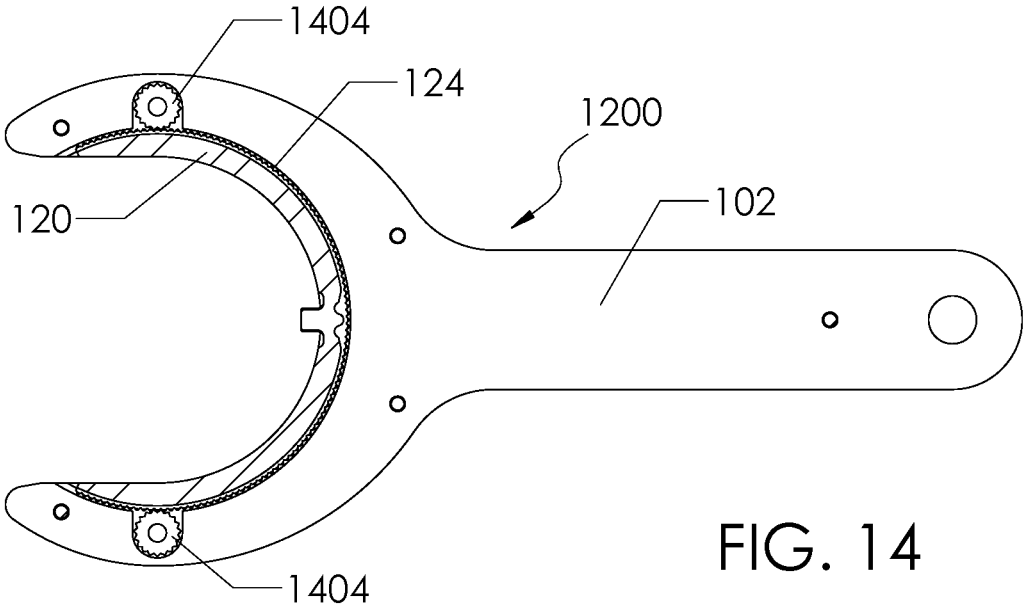
FIG. 14 shows an embodiment of a driven ratcheting spanner where the drive engagement bodies comprise spur gears.

In FIG. 14 a simplified section of a driven ratcheting spanner 1200 is shown wherein the drive engagement bodies comprise spur gears 1404 which can drive a ratchet ring 120 which has ratchet teeth 124 which are designed to mesh with the spur gears 1404. The coordinated rotation of the spur gears 1404 allows transmission of torque to the ratchet ring 120 without relative movement of the spanner body 102.

Figure 15:
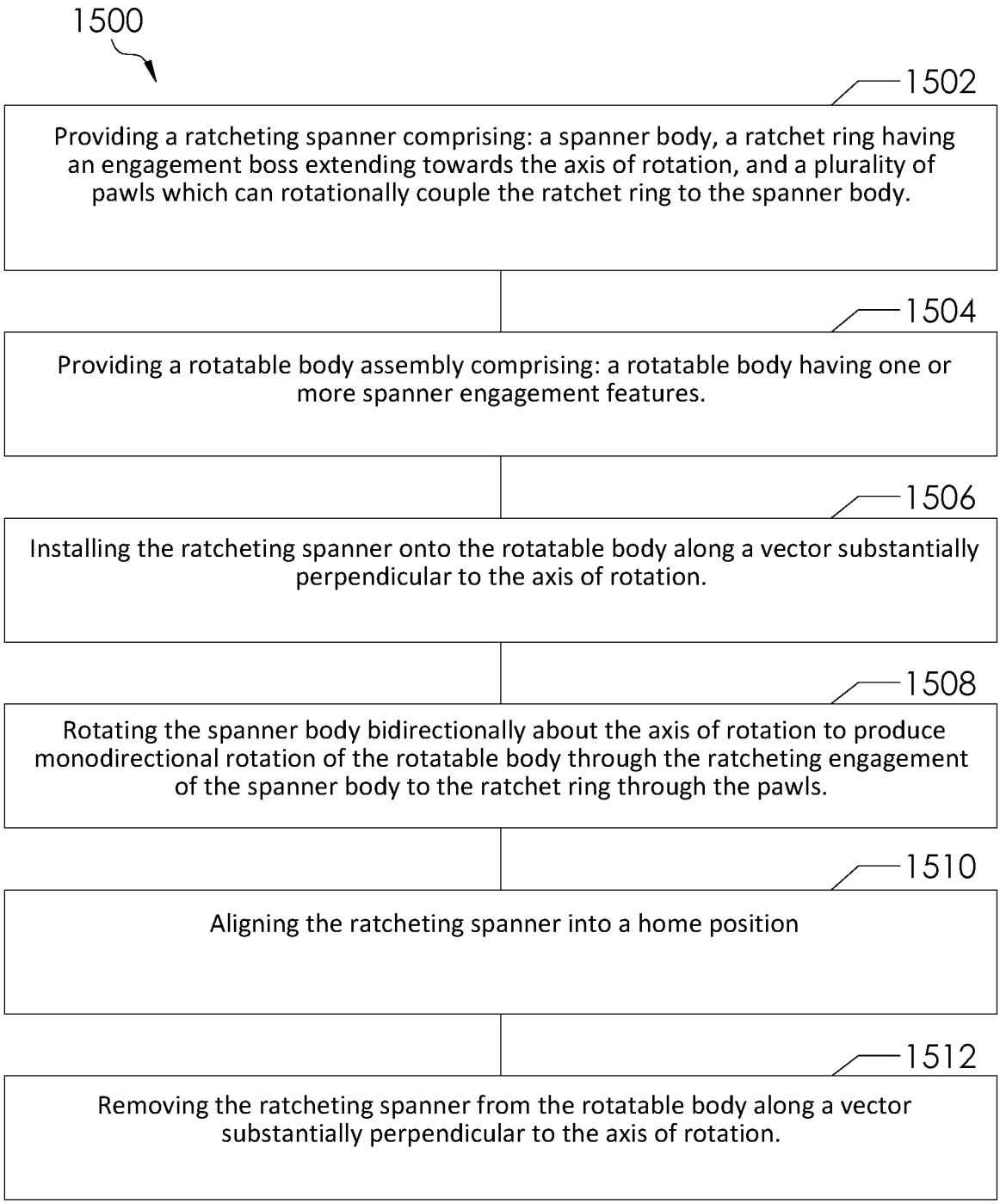
FIG. 15 shows an embodiment of a method for rotating a rotatable body with spanner engagement features.

In FIG. 15 an embodiment of a method for rotating a rotatable body with spanner engagement features is depicted. The method 1500 is depicted as a plurality of blocks or operations. The method 1500 includes providing a ratcheting spanner comprising a spanner body, a ratchet ring having an engagement boss extending towards the axis of rotation, and a plurality of pawls which can rotationally couple the ratchet ring and spanner body 1502 as well as providing a rotatable body assembly comprising a rotatable body having spanner engagement features 1504. The ratcheting spanner can be installed on the rotatable body along a vector substantially perpendicular to the axis of rotation 1506. Once the ratcheting spanner is installed, the spanner body can be rotated bidirectionally about the axis of rotation to produce monodirectional rotation of the rotatable body through the ratcheting engagement of the spanner body to the ratchet ring through the pawls 1508. The ratcheting spanner can then be aligned into a home position 1510 and removed from the rotatable body along a vector substantially perpendicular to the axis of rotation 1512.

Although example assemblies, geometries, methods, and systems have been described herein, the scope of coverage of this patent is not limited to these embodiments. On the contrary, this patent covers every ratcheting spanner and article of manufacture fairly falling within the scope of the appended claims either literally or under the doctrine of equivalents.

What is claimed is:

1. A ratcheting spanner wherein the ratcheting spanner comprises:

a spanner body comprising:

an opening wherein said opening allows said spanner body to be installed onto a rotatable body along a vector substantially perpendicular to an axis of rotation a ratchet ring disposed within said spanner body comprising:

an opening wherein said opening allows said ratchet ring to be installed onto said rotatable body along a vector substantially perpendicular to said axis of rotation an engagement boss disposed on the inner perimeter of said ratchet ring and extending towards said axis of rotation said boss being aligned such that it is substantially parallel to said opening in said ratchet ring and configured for engagement with one or more spanner engagement features recessed in an outer surface of said rotatable body a plurality of pawls disposed within said spanner body and adjacent to said ratchet ring wherein said pawls allow rotational coupling of said ratchet ring to said spanner body relative to said axis of rotation.

2. The ratcheting spanner of claim 1 wherein said ratcheting spanner further comprises a selector adjacent to the pawls such that the action of said pawls can be selectively controlled to produce rotational coupling between the spanner body and the ratchet ring in either direction about the axis of rotation.

3. The ratcheting spanner of claim 1 wherein said ratcheting spanner further comprises a selector adjacent to the pawls such that the action of said pawls can be disabled to allow uncoupled rotation of the spanner body relative to the ratchet ring about the axis of rotation.

4. The ratcheting spanner of claim 1 wherein said ratcheting spanner further comprises a selector adjacent to the pawls such that the action of said pawls can be controlled to produce bidirectional rotational coupling between the spanner body and the ratchet ring about the axis of rotation.

5. The ratcheting spanner of claim 1 wherein the disposition of the spanner body, the ratchet ring, and the pawls causes a home position to coincide with one of a plurality of ratchet engagement positions.

6. The ratcheting spanner of claim 1 further comprising a ratchet ring home geometry disposed along the perimeter of the ratchet ring and a home key disposed between the spanner body and said ratchet ring said home key comprising a home key engagement surface disposed adjacent to the perimeter of said ratchet ring said home key engagement surface being biased into contact with said ratchet ring home geometry the engagement of said ratchet ring home geometry and said home key engagement surface configured such that the resistance to continuing rotation of said ratchet ring about the axis of rotation increases in the home position defining a mechanical detent indicating the alignment of the openings in the spanner body and said ratchet ring.

7. The ratcheting spanner of claim 6 further comprising a selector control comprising a selector profile geometry adjacent to the home key which selectively contacts said home key to prevent the engagement of said home key with the ratchet ring.

8. The ratcheting spanner of claim 7 wherein the selector control comprises one or more selector profile geometries adjacent to the home key and the selector such that contact between one or more said selector profile geometries and said home key and one or more said selector profiles and said selector allows said selector control to both selectively allow contact of said home key with the ratchet ring and selectively allow contact of one or more of the pawls with said ratchet ring.

9. The ratcheting spanner of claim 6 further comprising a home key engagement surface disposed on the perimeter of the home key adjacent to the ratchet ring comprising an outside contact surface which engages with a ratchet ring end at an angle such that the resistance to continuing rotation of said ratchet ring about the axis of rotation from said contact is less than that of the detent between the spanner body and the ratchet ring in the home position.

* * * * *